US007422073B2

(12) United States Patent
Hagemeyer

(10) Patent No.: US 7,422,073 B2
(45) Date of Patent: Sep. 9, 2008

(54) GROUND WORKING IMPLEMENT AND METHOD FOR INTRODUCING A WORKING ELEMENT INTO THE GROUND

(75) Inventor: Carl Hagemeyer, Olpe (DE)

(73) Assignee: Eurodrill GmbH, Olpe (DE)

( * ) Notice: Subject to any disclaimer, the term of this patent is extended or adjusted under 35 U.S.C. 154(b) by 0 days.

(21) Appl. No.: 11/214,804

(22) Filed: Aug. 31, 2005

(65) Prior Publication Data

US 2006/0042811 A1 Mar. 2, 2006

(30) Foreign Application Priority Data

Sep. 1, 2004 (DE) ..... 10 2004 042 369

(51) Int. Cl.
*E21B 1/24* (2006.01)

(52) U.S. Cl. ..... 173/1; 173/17; 173/200

(58) Field of Classification Search ..... 173/1, 173/17, 49, 105, 200, 48; 91/279, 299, 319; 175/56, 58; 405/232
See application file for complete search history.

(56) References Cited

U.S. PATENT DOCUMENTS

| | | | | | |
|---|---|---|---|---|---|
| 2,672,322 | A | | 3/1954 | Bodine | |
| 3,096,833 | A | | 7/1963 | Bodine | |
| 3,146,835 | A | | 9/1964 | Hornstein | |
| 3,371,726 | A | * | 3/1968 | Bouyoucos | 173/207 |
| 3,774,502 | A | * | 11/1973 | Arndt | 91/246 |
| 3,786,874 | A | | 1/1974 | Jodet et al. | |
| 3,945,442 | A | * | 3/1976 | Amtsberg | 173/10 |
| 4,056,123 | A | * | 11/1977 | Kimura et al. | 137/624.14 |
| 4,155,287 | A | | 5/1979 | Selsam | |
| 4,534,419 | A | * | 8/1985 | Vural | 173/1 |
| 4,601,349 | A | | 7/1986 | Arentsen | |
| 4,650,008 | A | * | 3/1987 | Simson | 173/91 |
| 4,659,294 | A | * | 4/1987 | Barthomeuf | 417/397 |
| 5,038,668 | A | * | 8/1991 | Arndt et al. | 91/290 |
| 5,884,713 | A | * | 3/1999 | Shinohara et al. | 173/206 |

FOREIGN PATENT DOCUMENTS

| | | | |
|---|---|---|---|
| DE | 102 37 407 | A1 | 4/2004 |
| EP | 0 824 971 | A1 | 2/1998 |
| GB | 2 060 742 | A | 5/1981 |
| WO | WO 2004009298 | A1 | 1/2004 |

* cited by examiner

*Primary Examiner*—Brian D. Nash
*Assistant Examiner*—Nathaniel Chukwurah
(74) *Attorney, Agent, or Firm*—Jacobson Holman PLLC

(57) ABSTRACT

The invention relates to a ground working implement and to a method for introducing a working element into the ground, using vibrations. By means of a vibration generator vibrations are generated and transmitted to the working element during its introduction into the ground. According to the invention a gentle vibration generation and transmission are brought about in that the vibration generator has at least one vibrating piston mounted in linearly displaceable manner in a casing spaced from the working element. The vibrating piston is driven in oscillating manner in the casing for generating vibrations. The vibrations are transmitted via the casing to the working element.

13 Claims, 5 Drawing Sheets

Figure 1:
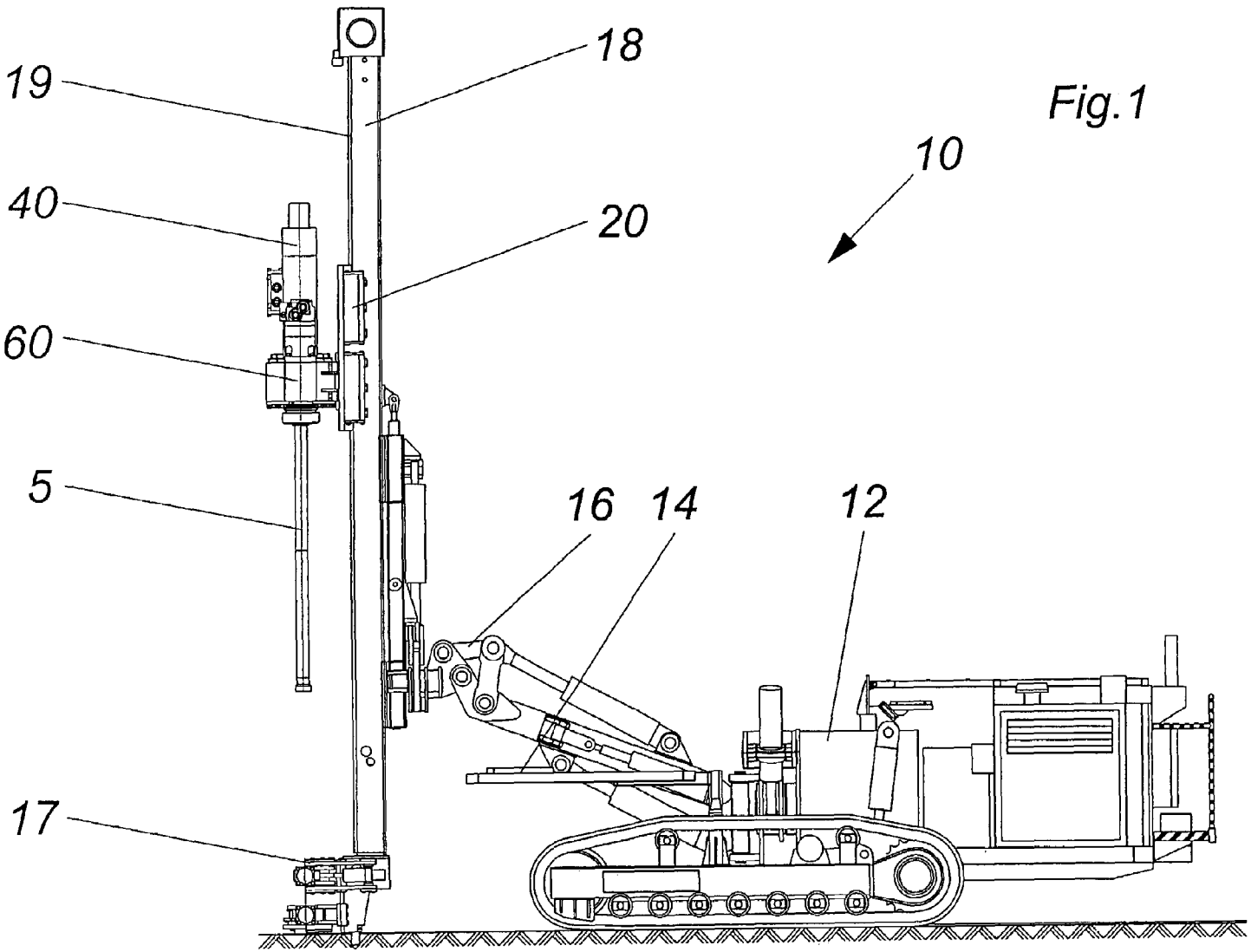

GROUND WORKING IMPLEMENT AND METHOD FOR INTRODUCING A WORKING ELEMENT INTO THE GROUND

The invention relates to a ground working implement for introducing a working element into the ground using vibrations, having a vibration generator constructed for generating and transmitting vibrations to the working element. The invention also relates to a method for introducing a working element into the ground, where vibrations are generated and transmitted to the working element during its introduction into the ground.

For driving sheet piles or piles into the ground so-called vertical vibrators with vibrating cells are known. Such a vertical vibrator is e.g. known from EP 0 824 971 B1. The vibrating cell described therein has pairwise driven, rotating unbalances, which are synchronized by gear wheels, so that the resulting mass forces substantially only occur in one action direction. The laterally acting centrifugal forces are supposed to be mutually compensated by the special synchronization of the gear wheels.

The prerequisite for this are close manufacturing tolerances in connection with the tooth systems. In addition, the shafts carrying the unbalances must be made correspondingly large for minimizing sag, which leads to a corresponding construction size of such a vibrating cell. As a result of the strong mechanical loading, the tooth systems must be manufactured with high strength and surface quality. In addition, the life of the antifriction bearings is limited through the strong dynamic loading.

Another problem with these known vibrating cells is that in the case of large units, due to inertia, they can only be slowly accelerated from the stationary state to the rated speed. Generally it is necessary to traverse a first or higher order resonant frequency. The risk exists of an increased amplitude which can lead to damage. To avoid this, in the case of large units, the unbalances are generally arranged in outwardly pivotable manner, so that they are only connected in when the rated speed is reached. However, this requires a complicated additional device, which further increases the construction size and the costs of the overall apparatus.

DE 102 37 407 A1 discloses a percussion hammer with a hydraulically driven percussion piston. The percussion piston is linearly displaceably mounted in a piston casing into which issue control lines for the supply and removal of hydraulic fluid. By means of said lines the hydraulic fluid is supplied and removed in controlled manner, so that an oscillating movement is imparted to the percussion piston. The impact surface of the percussion piston projects from the piston casing. As a result of the oscillating movement of the percussion piston, by means of the impact surface impacts can be exerted on a rear end of a boring rod, so that percussive boring can be carried out.

There is considerable noise emission during said mechanical impact production. The impacts pass through the boring rod in the form of a sound wave, the boring rod located in the open acting as a resonator which cannot be damped and most of the sound is emitted into the environment. Thus, such percussion boring cannot be used on certain building sites with strict noise abatement regulations. In addition, mechanical impact production leads to a considerable loading of all components, particularly bearings, guides and seals, so that the life thereof is significantly reduced.

The object of the invention is to provide a ground working implement and a method for introducing a working element into the ground, in which vibrations can be effectively and very gently transmitted to the working element.

According to the invention the object is achieved by a ground working implement having the features of claim 1 and a method having the features of claim 12. Preferred embodiments of the invention are given in the dependent claims.

The ground working implement according to the invention is characterized in that the vibration generator has at least one vibrating piston, which is mounted in linearly displaceable manner in a casing and is spaced from the working element, that the vibrating piston is driven in oscillating manner for generating vibrations and that the vibrations can be transmitted via the casing to the working element.

A fundamental idea of the invention is that the piston driven in oscillating manner is placed in a closed casing. Vibration transmission takes place indirectly via the casing. Unlike in the case of a hydraulic percussion hammer there is no percussive contact between metal parts, so that with the invention the noise produced is significantly reduced. The inertia of the mass to be accelerated within the vibration generator is very low, so that a possible resonant range can be traversed very rapidly. There are also no dead masses which also have to be accelerated. In addition, no lateral mass forces can arise. Components mounted in rotary manner and susceptible seals within the casing and piston can be obviated. The components used are simple and robust, so that they are very suitable for building site conditions. The overall device can be made very compact.

According to the invention a particularly high vibration energy can be generated by the vibrating piston being driven hydraulically. A hydraulic pressure generator is provided on most underground construction machines used for soil or rock working.

It is particularly preferred according to the invention for the vibrating piston to have a first piston surface and a second piston surface, whereof at least one is alternately pressurized. This makes it possible to set a virtually random oscillating movement of the vibrating piston, which preferably has a sinusoidal, harmonic distance-time curve. Pressurization can be brought about by an equally high pressure, which has to be alternately exerted on the facing piston surfaces. Alternatively a constant pressure can be exerted on one piston surface, whereas a rising and falling pressure is exerted on the facing piston surface in order to produce the oscillating movement of the vibrating piston.

Fundamentally the two piston surfaces can have the same size. However, as a function of the settable pressure ratios it is possible to have a different aspect ratio of the two piston surfaces, namely approximately 2:1. This makes it possible to set even more freely the oscillation behaviour of the vibrating piston.

According to the invention a simple, robust control can take place by constructing the vibrating piston as a primary control piston which is able to control the alternating pressurization. Control takes place so-to-speak in "self-excited manner". The vibrating piston is constructed with control edges forming the function of a first control piston. As a function of the vibrating piston position it is possible to have an automatic reversal of pressurization. Such a control of an oscillating piston is already known from the operation of the percussion piston in the prior art hydraulic percussion hammers.

A construction according to the invention is obtained in that a control device is provided with which it is possible to control the vibrating piston movement. As a result of such a control device, which can e.g. have an external control valve, vibrating piston control so-to-speak takes place in "separately excited manner". Preferably the control device comprises an electronic control unit for controlling or regulating the supply and removal of pressure fluid in order to set a desired vibration behaviour of the vibrating piston. The control device can also have a secondary control piston through which the pressure fluid is alternately supplied.

According to the invention the working element can be a sheet pile or pile, which is driven directly into the ground. According to the invention the vibration generator casing is fixed to a clamping device for holding the working element. Thus, by means of the casing and the clamping device, the vibration generated can be directly transmitted to the working element.

According to the invention the vibration generator casing is located on a boring drive casing and the working element is constructed as a boring tool. According to the invention it is possible to achieve a particularly gentle superimposing of the rotary boring movement and the oscillating movement in the boring direction. This allows a high boring advance whilst providing a particularly good protection of the boring tool and in particular the boring drive with its bearings.

According to another preferred embodiment of the invention the working element has a slide or carriage for receiving the working element and which is displaceably mounted on a guide. For example, by means of a cable or rack drive an additional force can be exerted via said carriage or slide on the working element in order to drive the latter into the ground. As a function of the soil conditions the force for driving the working element into the ground can be applied exclusively by the vibratory movements combined with the weight of the working element and the slide connected thereto. The slide can be guided on a mast or guide, which is e.g. fixed to an upper carrying chassis of a construction vehicle.

According to the invention a particularly low-vibration arrangement is brought about by the working element being flexibly mounted relative to the slide. A flexible bearing can be provided on the clamping device or the boring drive. Preferably the working element is flexibly suspended on the slide by means of the vibration generator casing. As a result the vibrations are transmitted in a largely undisturbed manner to the working element, whilst the slide and the working implement parts connected thereto remain very vibration-free.

In order to obtain a particularly good oscillating movement of the vibrating piston, according to the invention the vibrating piston has a through bore. The through bore permits a rapid venting of the cylinder chambers.

The method according to the invention is characterized in that the vibrations are generated with at least one vibrating piston, which is mounted in linearly displaceable manner in a casing and is spaced from the working element, that the vibrating piston is driven in oscillating manner for generating vibrations and that the vibrations are transmitted via the casing to the working element. This method can in particular be implemented by means of the previously described ground working implement according to the invention and this leads to the above-described advantages. The term ground is here understood to mean not only the soil, but also rock, e.g. rock walls. Vibration generation can be brought about using one or more vibrating pistons actuated parallel to one another.

According to the invention this method is further developed in that the working element is constituted by a boring tool driven in rotary manner and by the vibrations being transmitted in the boring direction to the boring tool. As a result of the inventively generated boring rod oscillation, frictional forces in the boundary surface with respect to the surrounding soil can be reduced. This leads to a much faster boring advance. The use of the inventive method is particularly advantageous for the overlying boring of lighter overlying soils, where the percussive action of a conventional hydraulic hammer could scarcely be appropriately used.

The invention is described in greater detail hereinafter relative to preferred embodiments and the attached diagrammatic drawings, wherein show:

FIG. 1 An example of an inventive ground working implement in a side view.

Figure 2:
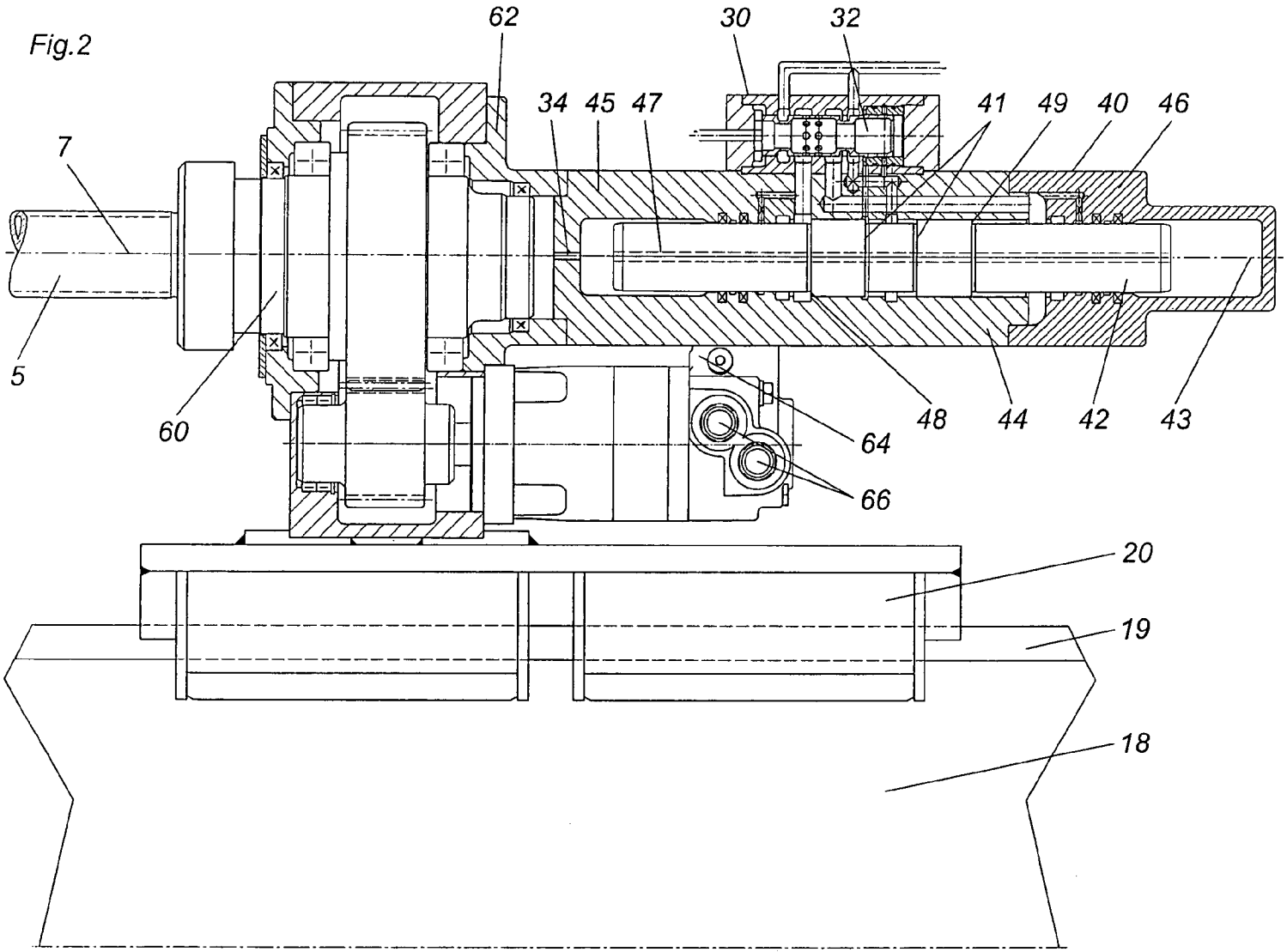

FIG. 2 A cross-sectional view of a boring drive with vibration generator.

Figure 3:
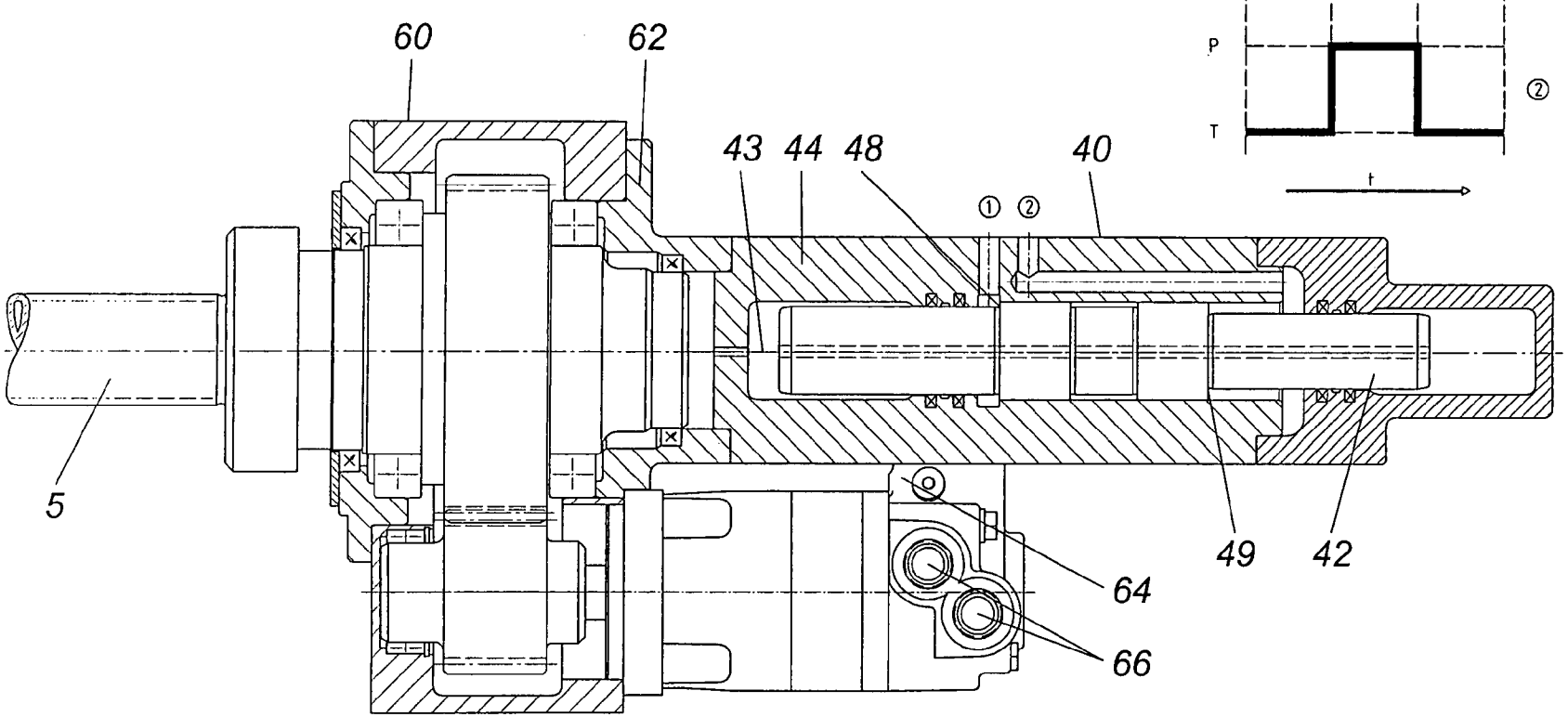

FIG. 3 A cross-sectional view of a boring drive with a modified vibration generator.

Figure 4:
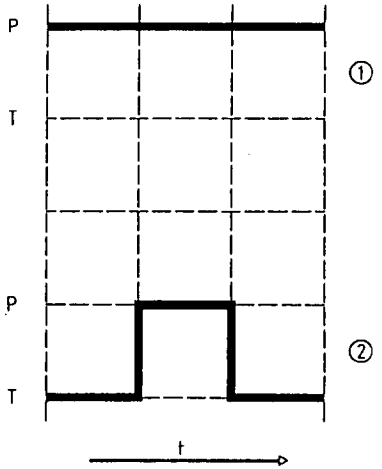

FIG. 4 A representation of the pressure curves over time.

Figure 5:
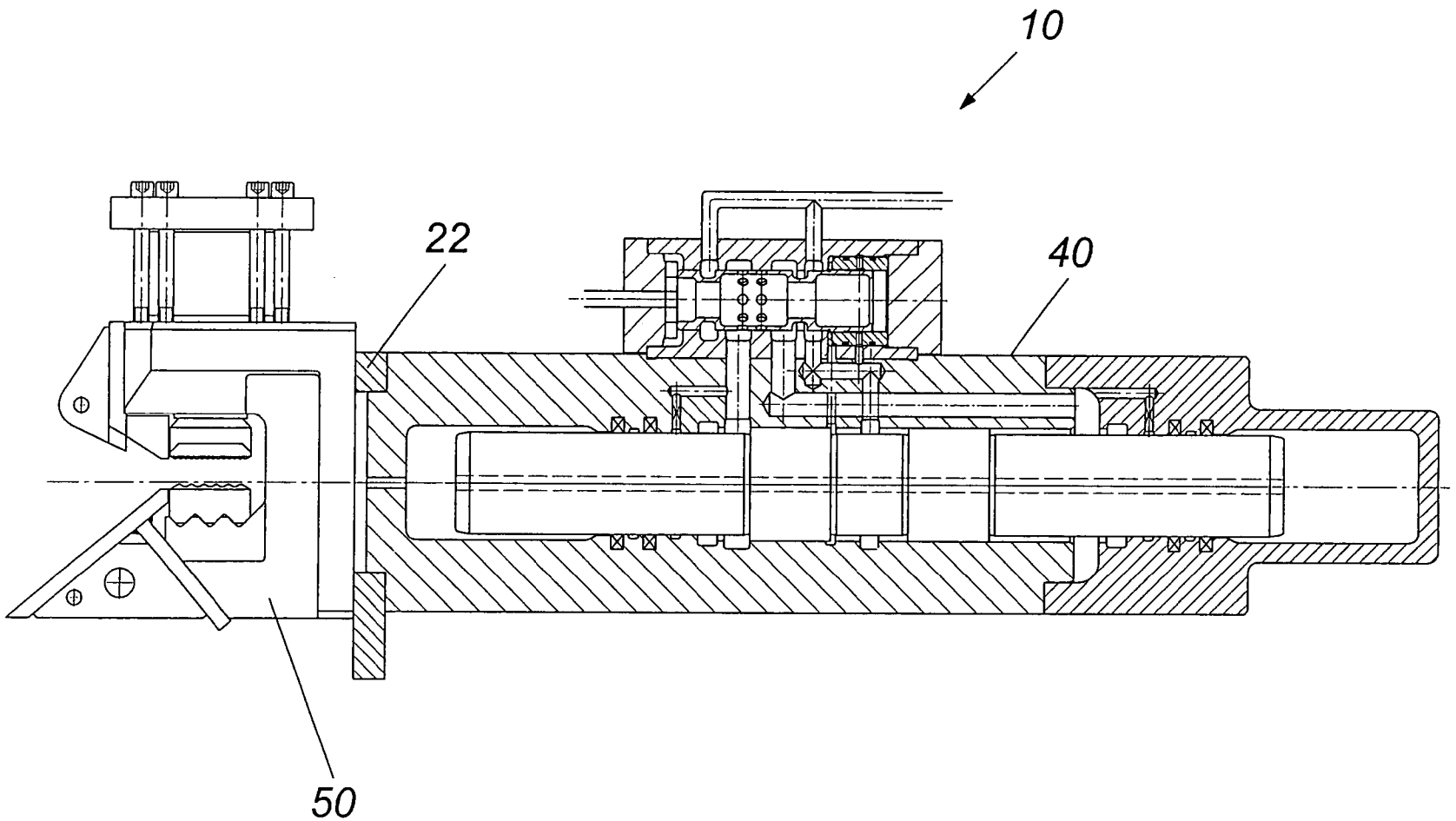

FIG. 5 A cross-sectional view of a vibration generator with clamping device.

Figure 6:
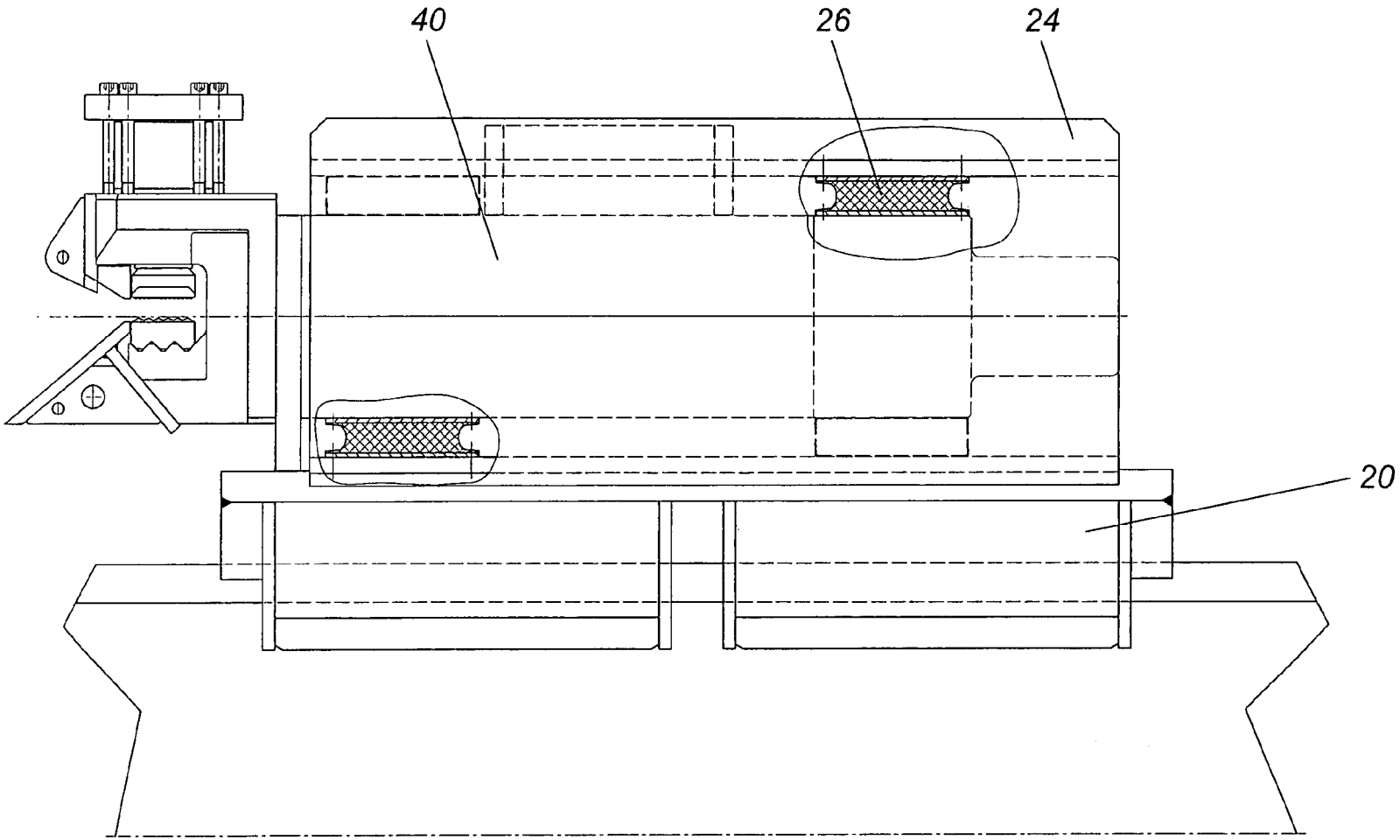

FIG. 6 A diagrammatic representation of a flexible suspension on a slide.

A tracked vehicle 12 with a control unit 14 is provided for the ground working implement 10 according to FIG. 1. By means of a lever mechanism 16 a mast 18 can be brought into a desired position where it can be placed on the ground or soil to be worked using a clamping and release device 17 provided on the lower end. The mast 18 has a linear guide 19 along which a slide or carriage 20 can be moved by means of a not shown drive. To the slide 20 is fixed a boring drive 60, which can drive in rotary manner a working element 5 in the form of a boring rod. To the side of the boring drive 60 remote from the working element 5 is fitted a vibration generator 40 with which, according to the invention, vibrations are generated and can be transmitted during boring to the working element 5 via boring drive 60.

FIG. 2 is a larger scale view of the boring drive 60 with vibration generator 40. By means of its drive casing 62 the boring drive 60 is welded to the slide 20, which is mounted in linearly displaceable manner on the guide 19 of mast 18. By means of a not shown hydraulic motor 64 with hydraulic connections 66 the working element 5 constructed as a boring rod is rotated about the boring axis 7 by means of a toothed gearing.

To the side of the boring drive 60 remote from the working element 5 a casing 44 of the vibration generator 40 is flanged to its drive casing 62. The casing 44 comprises a base casing 45 closed by a cover 46. The casing 44 embraces a cylinder area in which a vibrating piston 42 is mounted in linearly displaceable manner along a piston axis 43. The piston axis 43 is aligned with the boring axis 7 of the working element 5 to be driven in order to ensure a good vibration transmission.

The vibrating piston 42 has two cylindrical steps or shoulders, which on their outsides directed towards the free ends form a first piston surface 48 and a second piston surface 49. In each case the two piston surfaces 48, 49 close an adjacent pressure chamber with respect to which using pressure lines alternately a pressure fluid can be supplied and removed in order to give the vibrating piston 42 a desired oscillating or reversing linear movement. For bringing about alternating pressurization, in the case of the embodiment shown there is a control device 30 with an additional control piston 32, which with the control lines leading into the cylinder area and control edges provided on the vibrating piston 42 brings about a self-excited pressure reversal. Such a self-excited control of an oscillating piston is fundamentally known from the prior art in connection with hydraulic hammers, so that there is no need to further describe said control.

For the mutual venting of the two terminal cylinder chambers in casing 44, the vibrating piston 42 is provided with a through bore 47. Additionally the fundamentally sealed casing 44 is vented to the closed drive casing 62 by an air vent 34.

FIG. 3 shows a modified form of the vibration generator 40 of FIG. 2. Whereas with the vibration generator 40 of FIG. 2 the first piston surface 48 and second piston surface have an identical construction, in the embodiment of FIG. 3 the second piston surface 49 is twice as large as the first piston surface 48. In addition, only two pressure lines 1 and 2 issue into the casing 44. The control device can be constituted by electrically or hydraulically operated valves, which are not shown. Thus, unlike in the embodiment of FIG. 2, it is possible to bring about a separately excited control, i.e. which is independent of the position of vibrating piston 42. Otherwise the embodiment of FIG. 3 is constructed like the embodiment of FIG. 2. The embodiment of FIG. 3 can be given self-excited vibrations using the control of FIG. 2.

FIG. 4 diagrammatically shows the pressure curve at pressure connections 1 and 2. Thus, there can be a constant pressure at pressure connection 1, whereas at pressure connection 2 there is a pressure changing in the time curve, so that the desired oscillating movement of the vibrating piston 42 is produced. The reaction to the vibration of vibrating piston 42 is a vibration of casing 44, which is transmitted via the annular contact surface coaxial to the piston axis to the drive casing 62. By means of the drive casing 62 of boring drive 60 the vibrations are transmitted to the working element 5, so that a rotary movement of a drilling rod can be superimposed with axial vibrations.

In the case of the ground working implement 10 according to FIG. 5 use is made of a vibration generator 40 such as has been described for the embodiment of FIG. 2. In the embodiment according to FIG. 5, the vibration generator 40 is rigidly connected by a flange element 22 to a clamping device 50, which is constructed for retaining a sheet pile. When fitted to a vertically displaceable slide, the working implement 10 shown can tamp or jolt into the ground a sheet pile.

FIG. 6 shows a preferred suspension of the vibration generator 40 on slide 20. To the slide 20 is fixed a casing 24 in which the vibration generator 40 is flexibly suspended by rubber bearings 26. The rubber bearings 26 are constructed with a metallic inner and a metallic outer fastening. Between said two metallic, preferably annular fastenings there is a flexible rubber mass, which prevents an excessive vibration transmission from vibration generator 40 to casing 24 and the slide 20 connected thereto. Thus, most of the vibration energy can be transmitted to the working element 5 to be introduced into the ground.

The invention claimed is:

1. Method for introducing a working element into the ground, using a ground working implement, the method comprising the steps of:

providing a casing;

attaching the working element to the casing;

providing a vibration generator having at least one vibrating piston which is mounted in linearly displaceable manner in the casing;

spacing the vibrating piston from the working element at all times; and driving the vibrating piston in oscillating manner for generating vibrations, the vibrations of the piston being transmitted to the working element indirectly by means of casing without percussive impact of the vibrating piston on the casing.

2. Method according to claim 1, wherein the working element is constituted by a boring tool driven in rotary manner and that the vibrations are transmitted in the boring direction to the boring tool.

3. A ground working implement for introducing a working element into the ground, the ground working implement comprising:

a casing;

attaching means for attaching the working element to the casing;

vibration generating means for generating and transmitting vibrations to the working element, the vibration generating means having at least one vibrating piston which is mounted in linearly displaceable manner in the casing, the vibrating piston being spaced from the working element at all times; and driving means for driving the vibrating piston in oscillating manner for generating vibrations, wherein vibrations of the piston are transmitted to the working element indirectly by means of the casing without percussive impact of the vibrating piston on the casing.

4. The ground working implement according to claim 3, wherein the driving means hydraulically drives the vibrating piston.

5. The ground working implement according to claim 3, wherein the vibrating piston has a first piston surface and a second piston surface, and the ground working implement further comprises means for subjecting at least one surface to an alternating pressure.

6. The ground working implement according to claim 5, wherein the piston surfaces are of different sizes.

7. The ground working implement according to claim 3, wherein the vibrating generating means further comprises:

means for applying alternating pressure to the vibrating piston; and a control piston for controlling application of the alternating pressure.

8. The ground working implement according to claim 3, further comprising a control device for controlling the movement of the vibrating piston.

9. The ground working implement according to claim 3, further comprising a clamping device on the casing of the vibration generating means for retaining the working element.

10. The ground working implement according to claim 3, wherein the casing of the vibration generating means is located on a driving casing of a boring drive and the working element is a boring tool.

11. The ground working implement according to claim 3, further comprising:

a guide; and a slide for receiving the working element, the slide being displaceably mounted on the guide.

12. The ground working implement according to claim 11, further comprising means for elastically mounting the working element to the slide.

13. The ground working implement according to claim 3, wherein the vibrating piston has a through bore.

* * * * *